United States Patent [19]

Johansson et al.

[11] Patent Number: 4,625,439

[45] Date of Patent: Dec. 2, 1986

[54] EXCAVATING TOOTH RETAINING MEANS

[75] Inventors: Arne Johansson, Karlskoga; Torsten Larsson, Nybro, both of Sweden

[73] Assignee: AB Bofors Wear Parts, Bofors, Sweden

[21] Appl. No.: 632,072

[22] Filed: Jul. 18, 1984

[30] Foreign Application Priority Data

Jul. 26, 1983 [SE] Sweden ..... 8304134

[51] Int. Cl.[4] ..... F02F 9/28

[52] U.S. Cl. ..... 37/142 R; 172/713

[58] Field of Search ..... 37/141 R, 141 T, 142 R, 37/142 A; 172/753, 49.5, 713, 749

[56] References Cited

U.S. PATENT DOCUMENTS

| | | | |
|---|---|---|---|
| 2,397,521 | 4/1946 | Askue | 37/142 R |
| 3,121,289 | 2/1964 | Eyolfson | 172/753 X |
| 3,520,076 | 7/1970 | Nichols | 37/141 R |
| 3,623,247 | 11/1971 | Stepe | 37/142 R |
| 4,338,736 | 7/1982 | Radigan | 37/142 A |
| 4,360,981 | 11/1982 | Bierwith | 37/141 T |
| 4,516,340 | 5/1985 | Launder | 172/713 |

FOREIGN PATENT DOCUMENTS

| | | | |
|---|---|---|---|
| 2264140 | 10/1975 | France | 37/142 A |

*Primary Examiner*—Richard J. Johnson

*Attorney, Agent, or Firm*—Pollock, Vande Sande & Priddy

[57] ABSTRACT

This invention relates to a wear-parts system for earth-moving machines such as digger, loading, and mining machines. This wear-parts system consists of a holder (2, 23) and at least one protruding wear-part (8, 24) in the form of a tooth or similar fixed on the front of the holder (2, 23) by means of a wedge or other locking device (15, 16, 38). According to the invention the wear-part lands directly against the holder within a forward (5, 25) and a rear landing area (7, 27) in which a landing free from play within the forward landing area (5, 25) is achieved by means of a wedging effect between the wear-part (8, 24) and the holder (2, 23) when the wear-part is pressed or drawn backwards into the holder while a landing free from play is achieved between both these parts within the rear landing area (7, 27) by means of the locking device (15, 16, 38) pressing two angled relative to each other landing surfaces (42, 43) in the rear of the wear-part against two opposite equivalently angled landing surfaces (40, 41) in the holder.

8 Claims, 10 Drawing Figures

EXCAVATING TOOTH RETAINING MEANS

This invention relates to a wear-parts system for earth-moving machines. The term wear-parts is the commonly accepted designation within the industry for all those more or less easily replaceable wear protectors and teeth such as scoops, rippers, cutters, etc., that are fitted on earthmoving equipment such as on digger, loading and mining machines, dredgers, bucket diggers and similar. As a rule, wear-parts systems consist of, more or less fixed holders and one or more of the actual wear-parts in the form of teeth, cutting edges, or similar fitted loosely on the front parts of the holders. The degree of ease with which a wear-part can be replaced is relative to the degree of wear it can be expected to be subjected to. Primarily the teeth projecting in front of the tools are subjected to very great wear. They or their frontal points, depending on to what extent they are removeable are therefore now fixed in their holders by an easily removeable locking device. The replacement of a damaged tooth can therefore normally be carried out within a few minutes. The previously mentioned holders are often welded on or in the front edge of the tool, but they can also be bolted, wedged, or fitted in some other way.

There are several different wear-parts systems at present on the market, but none of them are absolutely perfect. The greatest problem with these systems is that none of them have eliminated the play that exists between the holder and the mechanically fixed tooth or actual wear-part inside the holder. As a rule this play becomes greater through time and cannot be eliminated by simply replacing the wear-part as the landing surfaces of the holder become gradually worn because the actual wear-part moves inside the holder while working. To manufacture the parts of the wear-parts system to such fine tolerances that no initial play is present is not practical from the economic point of view since this would involve machining the landing surfaces to very fine tolerances. Wear-parts are bulk products which must be cast or forged to the final dimensions without the need for machining with the exception of normal trimming if they are to be sold at competitive prices.

This invention relates to a wear-parts system consisting of a front, easily removeable wear part such as a tooth point or similar past that is fixed to a more permanently attached holder. On this wear-parts system the landing surfaces between the front part, the actual wear-part, and the holder have been so formed that a fixation of the actual wear-part that is completely without play is achieved every time it is replaced with a new wear-part. Considering the degree of vibration that earth-moving tools are subjected to it can not be guaranteed that the fixation between the actual wear-part and the holder will be completely without play during the entire lifetime of the wear-part we consider it to be a considerable step forward the fact that is can be guaranteed that every new wear-part can be fitted in the holder without play being present even if the holder has previously held several wear-parts.

The fixation between the two coordinating parts of the wear-parts system is achieved by means of wedging which makes it possible to retighten an already fitted wear-part from if after hard usage it should become slack in the holder before it is worn out. The result being the same as though a new wear-part had been fitted i.e., a fit free from play.

There is nothing to prevent that part that hereinafter is referred to as wear-part being divided up into several easily replaceable parts e.g., an intermediate holder and a front tooth tip. These parts can then be fitted together according to the same principles as they are fitted in the previously mentioned holder. The parts can even be twisted and turned and have their location and function changed without conflicting with the principles of this invention.

According to this invention the points of contact between the holder and the actual wear-part are distributed over two landing areas of which the forward area seen in the working direction of the tool shall be as far forward as possible while the rear area shall lie as far away as possible from the forward area. The wear-part is to be relieved between these two landing areas so that it does not come into direct contact with the holder.

Within one of the landing areas the coordinating landing surfaces of the wear-part and the holder are formed to a taper in such a way that the force of cutting exerted on the wear-part forces the wear-part backwards against the landing surfaces on the holder so that a fit free from play is obtained within this area. The elimination of play is achieved by the effect of wedging directly between the parts. The same effect is achieved even when the wear-part is drawn backwards in the holder which occurs by means of a separate wedge that locks the wear-part in the holder. The forming of the various landing surfaces within the above-mentioned landing areas can be done in two different ways. According to the first method, an inwardly reducing tapered hole is formed in either the wear-part or the holder, into which the tapered in the same direction shaft or base section of the other part is entered and forms a fit. In this context it is appropriate to form both the tapered hole and the tapered shaft of the other part with a triangular cross-section and rounded-off and relieved transition areas between the flat tapered side surfaces. As a result of this forming the tensioning forces affecting the wear-part will intersect each other on the longitudinal symmetrical surface of the wear-part. The second form for the landing surfaces in the said landing areas gives the one part an I-beam shaped cross-section where the side edges of the flanges which face each other in pairs are chamfered at an angle so that the gap between them is widened outwards and the body-height of the I-beam reduces in the form of a wedge away from the other part. At the same time the other part is formed with two bosses opposite each other and facing away from the first part and outwards to the sides. The bosses are adapted for landing against the side edges of the flanges but not so deeply as to extend in to the I-beam shaped body of the first part. This version gives four self-centering landing points between the first and second parts within this landing area. The first version gives three.

Within the other landing area there is also the locking wedge that is used partly to draw together the parts and to lock them relative to each other, and partly to eliminate all play within this landing area. The wedge is therefore entered tangentially across the longitudinal direction of the wear-part and is widened rearwards in the direction of entering. The wedge is also given an angled chamfered flank. By means of this angled chamfered flank the wedge is widened towards its own widest side. This angled chamfered flank shall combine with an equivalently angled chamfered flank in either an other wedge which functions as an intermediate piece or in one of the parts which are connected to the wedge and normally consist of a wear-part and a holder in which the wear-part is to be locked fast. The wedge runs through the openings in that part which grips over the other part and lands against the other part along a flange or in a groove adapted for this purpose. When the wedge is driven into position it forces the parts together in their fitting direction and, due to the sideways developed forces between the chamfered flanks it moves the parts sideways relative to each other within the landing area where the wedge is located. This latter relationship causes both the parts to create a contact between each other free from play on the opposite side of the wedge and from the wedge as an intermediate piece free from play on that side where the wedge is located. If both the wear-part and the holder are formed with coordinating, angled, roof-shaped landing surfaces on the opposite side to the location of the wedge but within the same landing area a sideways free from play landing between both the parts is also achieved. In addition the same type of balance of forces as has already been described in connection with the earlier dealt with first type of landing within the first landing area is achieved. If two wedges that coordinate with each other are utilized i.e., that glide along two coordinating flanks partly in the longitudinal direction of the wedges and partly are moved sideways across the angled chamfered flanks, the one wedge can be fixed at an early stage and the other wedge is driven in along the first wedge.

The above basic principles for the wear-parts system according to this invention provide great possibilities for different versions as it is possible to furnish the wear-part with a shaft that is fitted in an opening in the holder and viceversa at the same time as the first and second landing areas can exchange places and the wedge can be located horizontally or vertically or any angle there between.

The wear-parts system according to this invention will now be described in more detail using some relevant examples.

DETAILED DESCRIPTION OF THE PREFERRED EMBODIMENTS

Figures 1, 2, 3, 4:
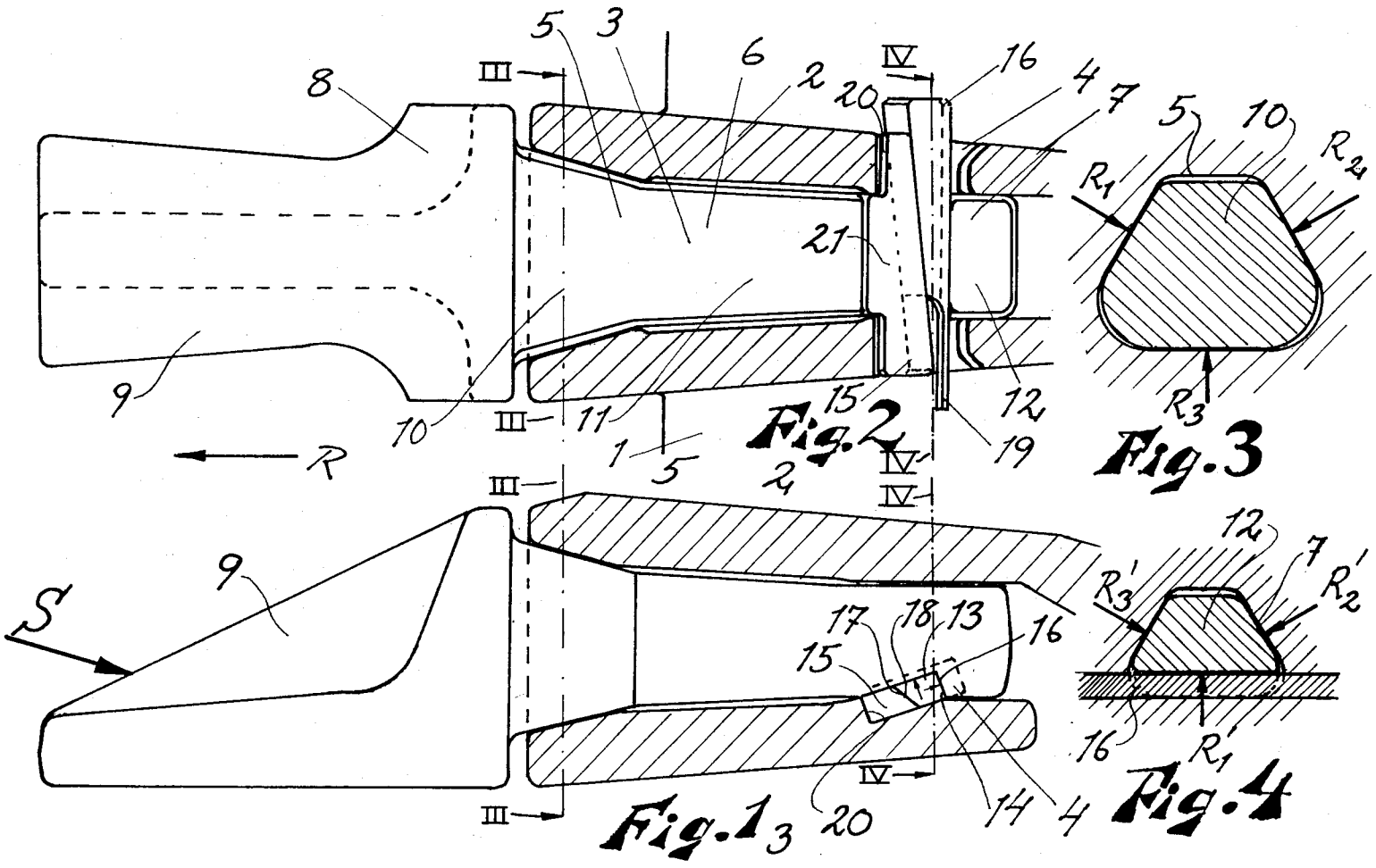
FIGS. 1 and 2 show sectioned side and perpendicular projections of a embodiment of the wear-parts system according to the invention
FIGS. 3 and 4 show sections taken along lines III—III and IV—IV in FIGS. 1 and 2 respectively.

FIGS. 1–4 have common figure symbols. In the bottom (1) of a loader scoop a holder (2) has been welded. The working direction of the loader scoop is marked R. The holder (2) has a longitudinal opening (3) and in its rear portion there is a tangential opening (4). The opening (3) has a pronounced tapered front part (5) that coincides with the previously mentioned front landing area. As can be seen from FIG. 3 the area (5) can have a more or less equally sided triangular cross-section with chamfered or relief-rounded and planed-off corners. After the area (5), area (6) follows along the opening (3). The area (6) is slightly tapered but it could also have parallel side edges. There then follows as and from in line with the opening (4), the area (7) which coincides with the previously mentioned rear landing area. As can be seen from FIG. 4 this area also has the same relieved triangular cross-section as the area (5) although with a smaller cross-section area and with parallel side edges. FIG. 1 also shows that the opening (4) is located in the lower edge of the opening (3).

A tooth (8) is fixed in the holder (2). This tooth (8) has a forward point (9) and a rearward shaft which is divided into a forward very tapered reducing rearwards part (10), a slightly tapered reducing rearwards intermediate part (11) and a more or less equally thick rear part (12). The part (19) is suited to the front part (5) of the hole (3). FIG. 3 shows the cross-section of the part (10). When the tooth (8) is working it is influenced by the normal working forces as shown in FIG. 1 and marked S. This creates the tension forces marked $R_1$–$R_3$ in FIG. 3. As can be seen in FIG. 3 the forces will intersect each other in the longitudinal center surface of the tooth. The tension forces having the same direction are generated when the tooth (8) is drawn backwards into the holder (2). This occurs with the aid of the locking wedges (15) and (16) fitted in the opening (4). The wedges (15) and (16) influence the holder (2) via the front edge (20) of the opening (4), and also the tooth via the tangential groove (13) with its rear edge (14) located in the rear of the said tooth.

The locking wedges (15) and (16) cooperate with each other via angled chamfered flanks (17) and (18) and they are also wedge-shaped in the normal way. The wedge (15) is provided with a locking surface (21) which ensures that the wedge remains firmly in the opening (4). When the wedge (16) is driven in along the wedge (15) it forces the tooth (8) rearwardly into the holder (2) and upwardly along the angled chamfered flanks (17) and (18) against the shaft (12) of the tooth which in turn is forced up against the roof of the holder (2). As can be seen in FIG. 4 both the tooth shaft (12) and the opening (3) within the area 7 have more or less the same shape as within the area 5 and the tooth shaft part (10). Also here three tension forces $R_1'$–$R_3'$ are created (see FIG. 4). The wedges (15) and (16) are directly responsible for the tension force $R_1'$, while $R_2'$ and $R_3'$ are the indirect result of the influence of the wedges. As already mentioned the wedge (15) is fixed and the wedge (16) has a locking tongue that can be hammered over in order to lock the wedge in position. Within the area (6) the tooth shaft's opposite part (11) is relieved so that it does not contact the holder.

FIGS. 5–8 shows another embodiment of this invention. These figures have the same reference symbols.

Figures 5, 6, 7, 8:
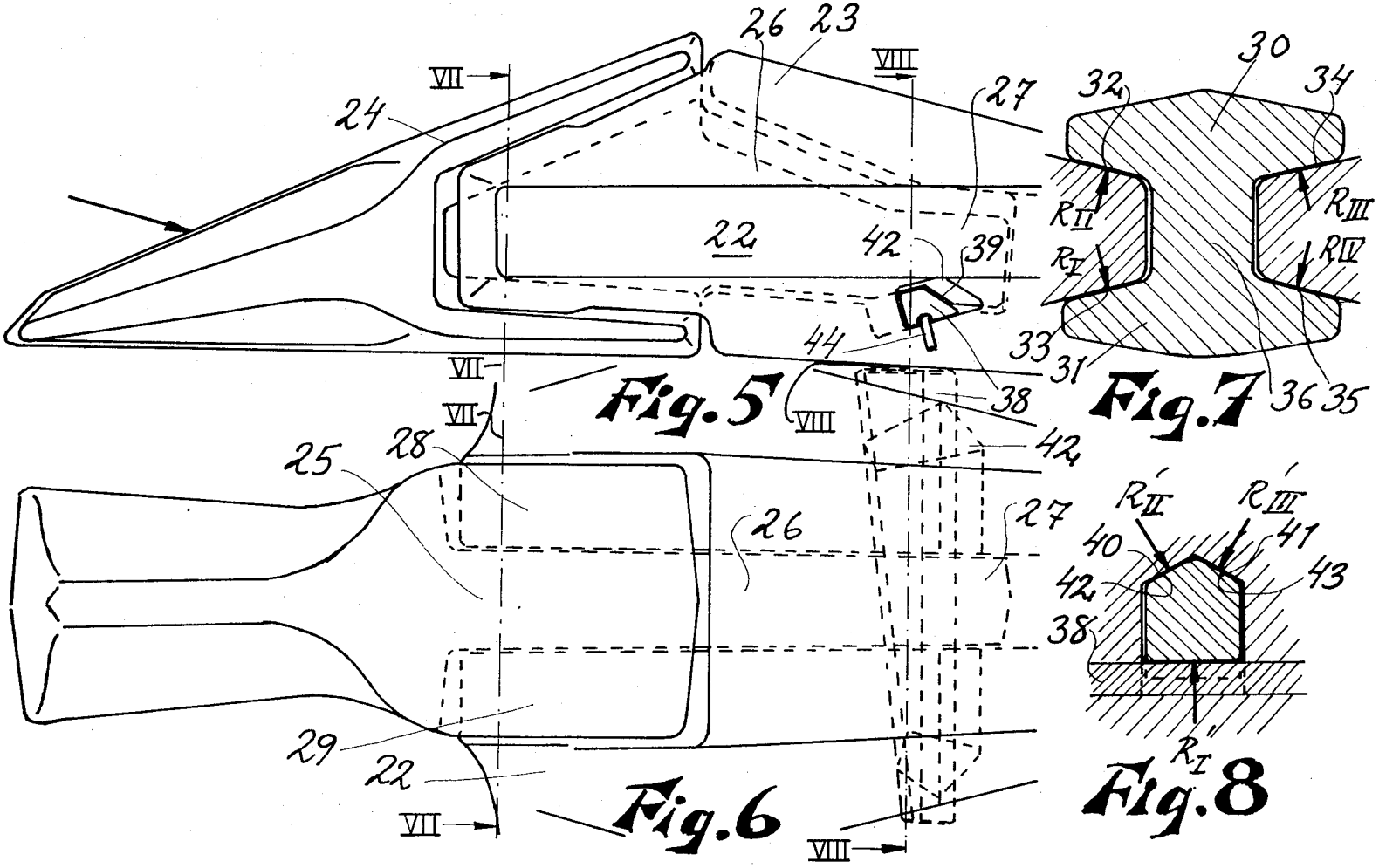
FIGS. 5 and 6 show side and perpendicular projections of another embodiment of the wear-parts system according to the invention.
FIGS. 7 and 8 show sections taken along lines V—V VI—VI in FIGS. 5 and 6 respectively.

In the bottom (22) of a loader scoop a holder (23) is welded fast. In the holder (23) a loading tooth is fixed. The holder (23) has a forwardly facing groove (25) that continues as a rearwardly reducing tapered opening part (26) that terminates in the evenly wide opening part (27). The groove (25) is flanked by two outwardly facing, to the side and rear, wedge-shaped, flaring bosses (28) and (29). That part of the tooth (24) that is entered in the groove (25) has a modified I-beam cross-section where the side edges (32, 33) and (34, 35) of the flanges (30) and (31) are angled relative to each other so that tapered grooves are formed between them inwardly towards the body (36) of the I-beam. In addition the I-beam body (36) reduces forwardly towards the tooth point. As can be seen in FIG. 7 the bosses (28) and (29) are adapted to the grooves between the side edges (32, 33) and (34, 35) of the flanges. A minor amount of play shall exist however between the bosses and the I-beam shaped tooth (24) body (36). The bosses (28) and (29) are completely protected from wear by the front part of the tooth (24). In FIG. 7 the tension forces $R_I$–$R_{IV}$ are also indicated. The tension forces are obtained through the influence of the wedge between the tooth (24) and the bosses (28) and (29) as the tooth is influenced by the normal force of cutting S when the relevant tool is working. The same four tension forces are obtained even when the tooth (24) is drawn rearwards into the holder (23). Both alternatives contribute towards a tensioning free from play of the tooth (24) within a forward tensioning area level with the bosses (28) and (29). In order to draw the holder rearwards into the holder to achieve a position which free from play even when it is not subjected to load, there is a tangentially fitted locking wedge (38) rear part that crosses the tooth (24) and proceeds through a crossing opening (42) through the holder and which via an angled chamfered flank (39) lands hard against a similarly angled chamfered flank in the lower rear part of the tooth. The locking wedge (38) with its angled flank and the angled flank of the tooth cooperate and similarly to wedges (15) and (16) in FIGS. 1–4. When the wedge is driven in the entire tooth (24) is forced rearwardly into the holder (23) and the part of the tooth within the area (27) is forced up against the roof of the opening (27). As can be seen in FIG. 8 the tooth and holder have a cross section with two upper angled landing surfaces (40) and (41), relative to each other, in the holder and (42) and (43) respectively in the tooth. The locking wedge (38) influences the rear part of the tooth up towards a free from play landing between the surfaces (40–43). Section D—D in FIG. 8 shows those forces $R_I$–$R_{III}$ which influence the tooth shaft. To lock the wedge (38) in its end position there is a locking wire (44) which can be staved down.

FIGS. 9–12 show a further embodiment of this invention. All of these figures have the same reference symbols.

Figures 9, 10, 11, 12:
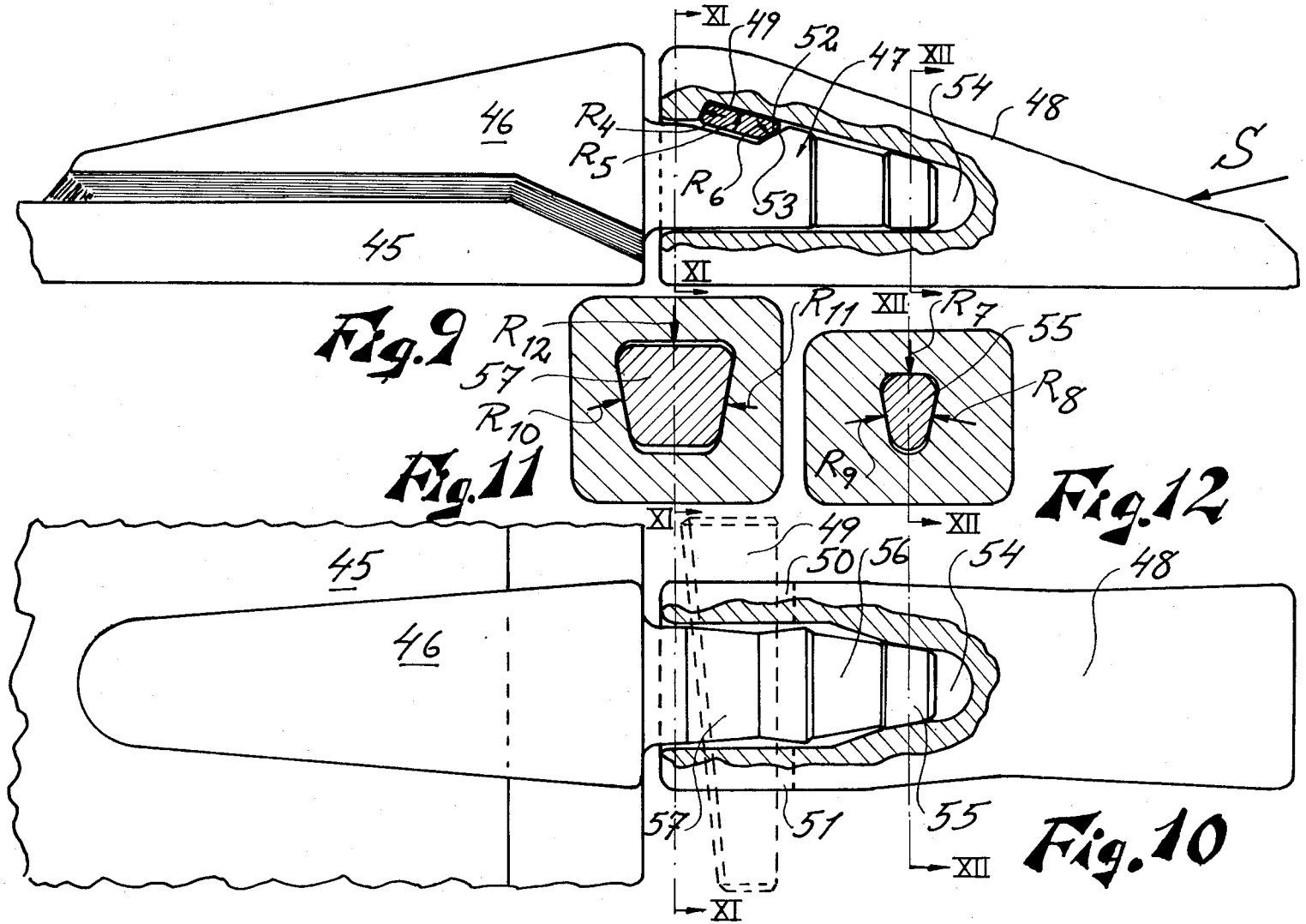
FIGS. 9 and 10 show partly sectioned side and perpendicular projections of another embodiment of the wear-parts system according to the invention.
FIGS. 11 and 12 show sections taken along lines XI—XI and XII—XII in FIGS. 9 and 10 respectively.

In the bottom (45) of a loader scoop a holder (46) is welded fast. The holder (46) has a protruding nose (47) that forms a fixing point for the cap type loader tooth (48). Holder and tooth are held together by a wedge (49) which is driven through two opposite openings (50) and (51) in the tooth and which via its angled chamfered flank (52) lands against a similarly angled chamfered flank (53) in the nose (47). Both the flanks (52) and (53) are angled chamfered in such a way that the wedge (49) strives to move sideways away from the nose (47) when it is driven in along the flank (53). The forces $R_{10}$–$R_{12}$ that influence along the flanks (52–53) are shown in FIG. 9. The nose (47) is formed so as to land against the inner cavity (54) in the tooth (48) within a forward landing area (55) and a rear landing area (57). Within the area (56) the nose (47) is clipped-off so that no direct contact between the nose and the tooth occurs.

As can be seen from FIGS. 9, 10, and 12, the nose (47) landing surfaces within the area (55), and the opposite landing surfaces within the opening (54) are wedge-shaped, angled chamfered forwardly in the working direction of the tooth (48) so that the tooth will be forced into a landing free from play against the nose (47) within this landing area. FIG. 12 shows those forces $R_7$–$R_9$ which influence within section taken along line XII—XII.

Within the rear landing area (57) the landing surfaces between the nose (47) and the cavity (54) are formed after the same principles as for the landing area (5) as shown in FIGS. 1–3. In this context reference is also made to the arrows indicating forces shown in FIG. 11 of which $R_{10}$ and $R_{11}$ are equivalent to the points of landing between the nose (47) and the relative to each other facing each other angled landing surfaces while the force indicating arrow $R_{12}$ refers to the sideways acting force which is transferred between the nose (47) and the tooth (48) via the flanks (52) and (53).

We claim:

1. A wear-parts system for tools in an earth moving machine having a holder member and a wear-part member, said members being releasably connected to each other by a protrusion on one of said members and a mating opening on the other of said members, said wear-part member being locked to said holder member by easily removable locking wedge means, wherein said holder member comprises a first tapered contact surface and a second contact surface, and said wear-parts member comprises a third tapered contact surface for coacting with said first tapered contact surface, and a fourth contact surface for coacting with said second contact surface, said first and third tapered contact surfaces being adapted to cooperate with each other in a first contact area and said second and said fourth contact surfaces being adapted to cooperate with each other in a second contact area, said first contact area and said second contact area being separated from each other by a zone in which there is a clearance between said holder member and said wear-part member, and said locking wedge means is located at said second contact area and comprises a wedge member having an angled chamfered flank for facing a cooperating angled flank, said locking wedge means being oriented to produce a wedging effect between said wear-part member and said holder member by forcing said wear-part member rearwardly in mating engagement with said holder member, and bringing said first and said third tapered surfaces into contact with each other in said first contact area, and forcing a portion of said second and fourth contact surfaces on the side opposite to said locking wedge sideways against each other in said second contact area to achieve contact which is free of play in both of said first and second contact areas.

2. A wear-parts system according to claim 1 wherein in the second contact area the contact surfaces of the wear-part member comprise two surfaces which are angled relative to each other, and the contact surfaces of the holder member comprise two corresponding opposite angled contacting surfaces.

3. A wear-parts system according to any one of claim 1 in which the holder member is provided with a forward protruding nose and the wear-part member is a tooth of the cap type having a central opening adapted for the nose.

4. A wear-parts system according to claim 1, wherein said contacting surfaces between said holder member and said wear-part member and said wedge within said second contact area are so angled relative to each other that the tension forces generated by driving said wedge into position intersect each other in said wear-part member.

5. A wear-parts system according to claim 1, further comprising a second wedge between said angled chamfered flank and said wear-part member having an oppositely facing angled second chamfered flank and wherein said first wedge slides along said second flank when driven in across the working direction of the wear-part member and with which said second wedge is locked sideways relative to said wear-part member.

6. A wear-parts system according to claim 5 wherein there are three of said contacting surfaces between said holder member and said wear-part member in said first contact area and said three surfaces are so angled relative to each other that they create a wedging effect when said wear-part member is forced rearwardly into said holder member and create tension forces which interest each other in the longitudinal symmetrical surface of said wear-part member.

7. A wear-parts system according to claim 5 wherein said wear-part member within said first contact area comprises an I-beam shaped cross-section having angled inner flanks and a forwardly reducing body height in the working direction of said wear-part member and wherein said angled flanks of said wear-part member are faced by corresponding contact surfaces of said holder member.

8. A wear-parts system according to claim 7 wherein there exists play between the body of the I-shaped beam and the near-by portions of the holder member.

* * * * *